United States Patent [19]

Thurmann

[11] 4,015,838

[45] Apr. 5, 1977

[54] APPARATUS AND METHOD OF FORWARDING SHEET FROM PAPER OR SIMILAR MATERIAL

[76] Inventor: Wilhelm Thurmann, Glueck-Auf-Strasse 7, Wilnsdorf-Obersdorf, Germany

[22] Filed: Oct. 30, 1975

[21] Appl. No.: 627,308

[30] Foreign Application Priority Data

Oct. 30, 1974 Germany ..... 2451469

[52] U.S. Cl. ..... 270/61 F; 270/68 R; 270/79

[51] Int. Cl.[2] ..... B65H 45/00

[58] Field of Search ..... 270/61 F, 73, 79, 39, 270/68 R, 69; 226/119

[56] References Cited

UNITED STATES PATENTS

| | | | |
|---|---|---|---|
| 3,466,027 | 9/1969 | Kwik | 270/79 |
| 3,747,917 | 7/1973 | Roda | 270/61 F |
| 3,841,621 | 10/1974 | Brown | 270/69 |

FOREIGN PATENTS OR APPLICATIONS

| | | | |
|---|---|---|---|
| 1,208,502 | 2/1960 | France | 270/79 |

*Primary Examiner*—Edgar S. Burr
*Assistant Examiner*—A. Heinz
*Attorney, Agent, or Firm*—Olson, Trexler, Wolters, Bushnell & Fosse, Ltd.

[57] ABSTRACT

A sheet of paper is folded by forming a portion of the sheet into S-shape with a folding loop of U-shape and a blind loop of opposite curvature, and pressing the opposite sides of the folding loop together in the direction from the open end towards the closed end of the loop, to produce a fold, while the shape of the blind loop is maintained without the sheet becoming folded in the region of this loop. Apparatus for performing the method is arranged to produce oppositely directed folds alternately along the length of the sheet. The opposite sides of the folding loop are pressed together by a folding roller which may cooperate with a table to both form the "S" loop and produce the fold, or a second roller which serves to clamp the sheet. In the latter arrangement a sheet deflector forms the folding loop between the two rollers when they are spaced apart, and in the former arrangement the folding roller is movable against the table, first in one direction to form the S loop and then in the opposite direction to press the folding loop against the table.

12 Claims, 14 Drawing Figures

APPARATUS AND METHOD OF FORWARDING SHEET FROM PAPER OR SIMILAR MATERIAL

This invention relates to a method of and apparatus for folding a sheet of material, such as paper or foil, by forming an open loop and pressing the opposite sides of the loop together in the direction from the open end of the loop to its rounded closed end to form a fold in the sheet.

A sheet of paper, for instance a sheet of notepaper is frequently folded manually in this way, the sheet being spread out flat on a table and held at one edge while the opposite edge is bent back over to form a loop in the sheet which is then pressed flat, from the open end of the loop to form the fold.

In U.S. Pat. No. 1,805,161 there is disclosed a sheet folding method in which the sheet is folded about a perforation line to form a loop which is then "stroked out" by a brush to flatten the fold. In other words, the sheet, previously bent about a perforation line, is pressed flat to complete the fold, the weight of the following sheet portions being inadequate for this purpose. This is only one of numerous possible methods in which the folding line is predetermined by embossing, such as perforating, the actual folding being performed by bending the sheet over along the embossed line. This method, which is generally known as blade folding, has the advantage that it enables the position of the fold to be determined with a high degree of accuracy, and due to the high folding speed attainable, the method has been successfully adopted in so-called upsetting folding for the folding of large sheets of paper, such as photocopies of drawings.

In upsetting folding a loop is first formed and then folded flat by moving the loop between a pair of rollers which first pinch the rounded closed end of the loop to form the folding line and then draw the opposite sides of the loop therebetween. The position of the folding line is to some degree left to chance, and relatively long folding lines are not always formed completely straight (usually due to sagging of the sheet), and this results in the sides of the loop being wrinkled when drawn through the folding rollers.

Upsetting folding has hitherto been used almost exclusively for folding photocopies of drawings and similar sheets, because, besides the high speeds which can be achieved, it enables successive multiple folding, as is often needed in this field, to be performed substantially continuously, since the folding rollers convey the folded sheet in the correct direction of advance for further foldings. In the method initially described, which guarantees perfectly straight folding lines, any rolling operations would have to be performed to some extent against the direction of advance of the sheet needed for further foldings.

In accordance with the present invention there is provided a method of folding a sheet of material, such as paper or foil, comprising forming a double loop of substantially S-shape configuration in a portion of the sheet, the double loop including a folding loop and a blind loop of opposite curvature, and pressing together the opposite sides of the folding loop from the open end of the loop towards the rounded closed end thereof to produce a fold, the shape of the blind loop being substantially maintained during the pressing of the folding loop, with the end of the blind loop opposite the folding loop directed towards the sheet portion connected thereto.

The term S-shaped is used herein to denote a true S and also the lateral inversion thereof.

Using this method a number of parallel folds can be made spaced apart along the length of a long sheet.

To allow the separation between adjacent folds to be varied, the folding loop can be produced from a first portion of predetermined minimum length and a second portion of adjustable length formed by feeding the sheet towards the first portion. The smallest interval between folds is therefore determined by the length of the first portion, and any larger folding line interval can be formed by an appropriate advance of the following second sheet portion and therefore corresponding enlargement of the folding loop. The formation of the double loop and the forward feed of the second sheet portion may be completed as a single operation.

The invention also provides an apparatus for performing the invention comprising: means defining a sheet feed path; clamping means for gripping a sheet extending along said feed path to impede movement of said sheet; deflecting means for deflecting said sheet away from said path for forming a double loop of substantially S-shape configuration in a portion of said gripped sheet, said double loop including a folding loop with opposed open and rounded, closed ends and opposed sides, and a blind loop of opposite curvature to said folding loop and having a free end opposite said folding loop attached to an adjacent sheet portion; and folding means for pressing together the opposite sides of the folding loop in the direction from the open end towards the rounded, closed end of the loop, said folding and deflecting means being so arranged that the shape of said blind loop remains substantially unaltered during said pressing and said free end of the blind loop is maintained during said pressing pointing in the direction towards said sheet portion to which it is attached.

The apparatus may include means for advancing the sheet along the path and the advancing means may conveniently also form the clamping means. The advancing device may be conveying device which conveys the sheet through the folding apparatus along the feed path and also advances the sheet during the formation of the double loop. The conveying device can advance the sheet intermittently, clamping the sheet when it is stationary. Alternatively, the conveying of the sheet can be continuous which can have the effect of increasing the size of the folding loop. If the speed of advance of the sheet is fixed, it can be arranged to ensure that even though the conveying device operates continuously, folding takes place along a predetermined folding line in the sheet.

In a preferred embodiment of the invention the folding means also forms the deflecting means and takes the form of a folding roller which rotates about an axis extending parallel with the plane of a sheet extending along the feed path and perpendicularly to the feed path. The folding roller is cooperable with a table surface extending transversely of the plane of the sheet feed path on both sides thereof, and is movable in one direction relative to the table to form the double loop and then in the opposite direction to press down the folding loop against the table. During this movement, the roller clamps the sheet between itself and the table, and rolls over the sheet, which does not move relative to the table.

Since as a rule the intention is to produce in the sheet of paper a series of alternately oppositely directed folds, two parallel, spaced apart deflecting and folding rollers may be disposed for cooperation with the table. The two folding rollers can be so coupled to one another that their separation always remains identical or independent control of the individual folding rollers can also be provided.

In an alternative embodiment the table includes at least one plate movable to project forwardly from the table surface for forming the double loop, and to be retracted behind the table surface during pressing down of the folding loop. To produce oppositely directed folds, two parallel plates are independently movable and disposed on opposite sides of the sheet feed path, each plate defining a folding surface against which the folding roller presses down the folding loop formed by the other plate. In this embodiment the forward movement of the plate or plates produces a freely suspended folding loop, which nevertheless is of precisely defined length.

In another embodiment of the invention the clamping means comprises a pair of clamping rollers which can be engaged with and disengaged from the sheet and are disposed in the sheet feed path downstream of the deflecting device. A folding roller can be brought into rolling contact with one of the clamping rollers, and the deflecting means is arranged to form the folding loop between the engageable clamping and folding rollers.

The folding roller does not constitute the deflecting means and no longer rolls on a table.

Some embodiments of the invention are described below in detail by way of example with reference to the accompanying drawings, in which.

Figure 7:
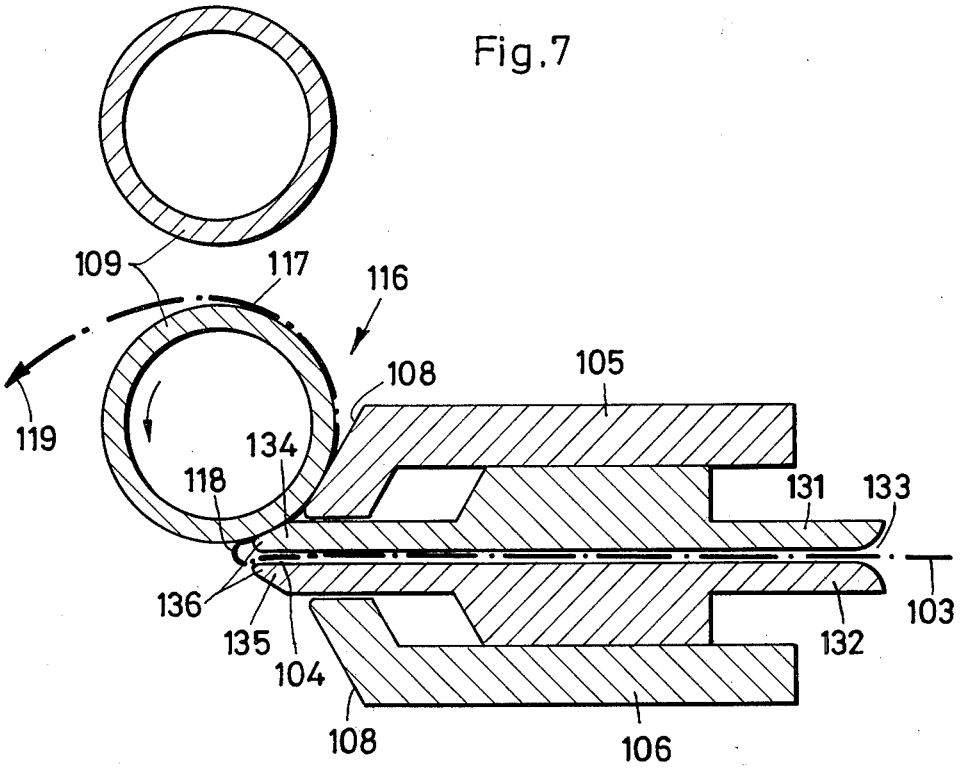
FIG. 7 is a diagrammatic cross-section, corresponding to FIG. 1, of a variant embodiment of the folding apparatus, after the formation of the double loop.
Figure 8:
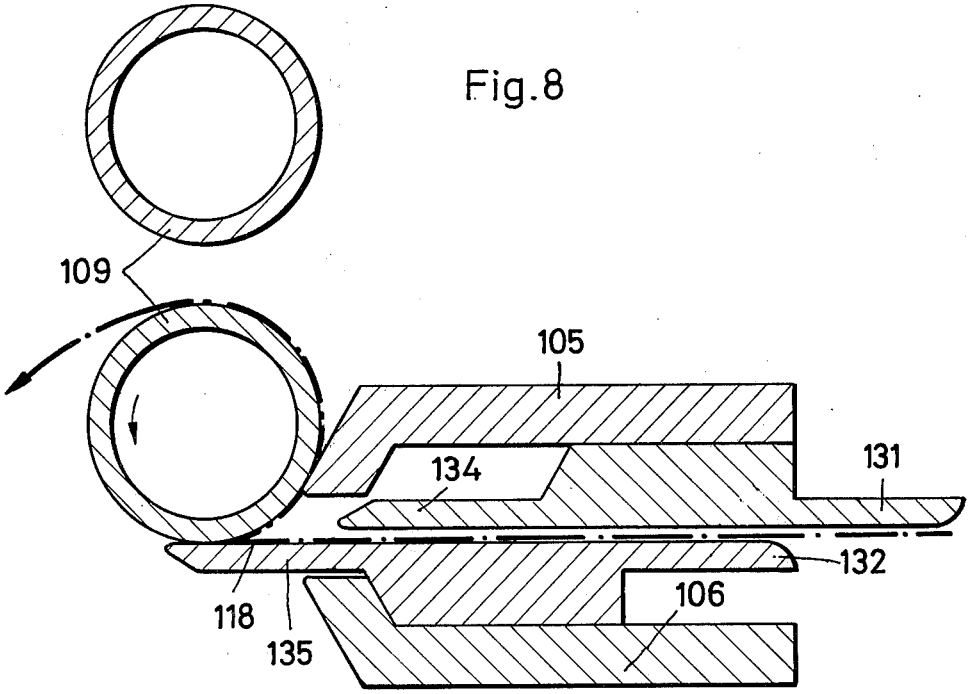
Figure 9:
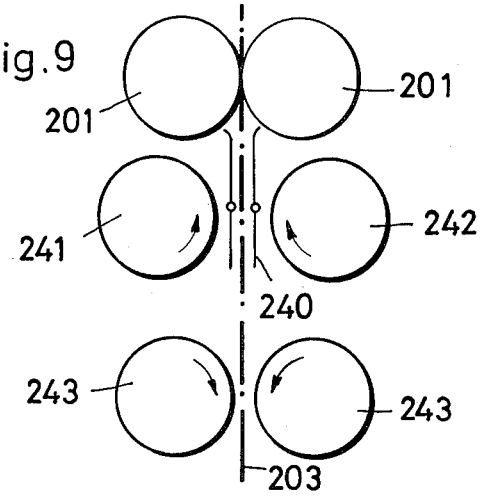
Figure 10:
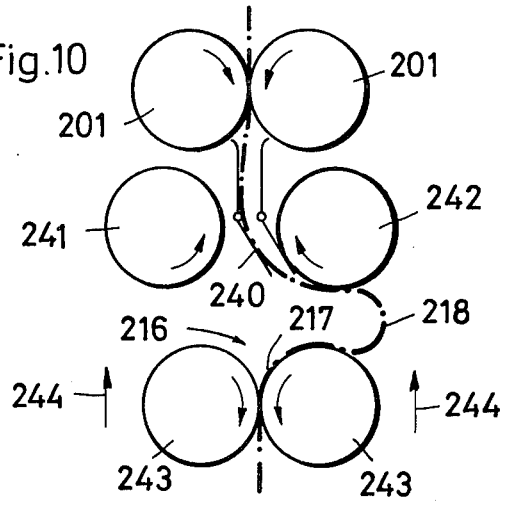
Figure 11:
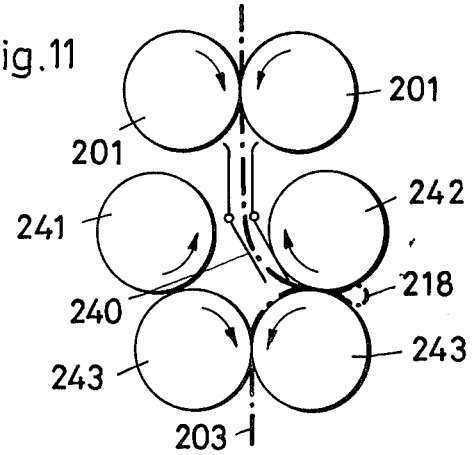
Figure 12:
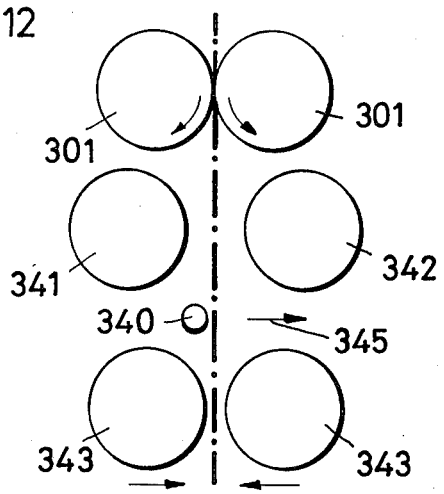
Figure 13:
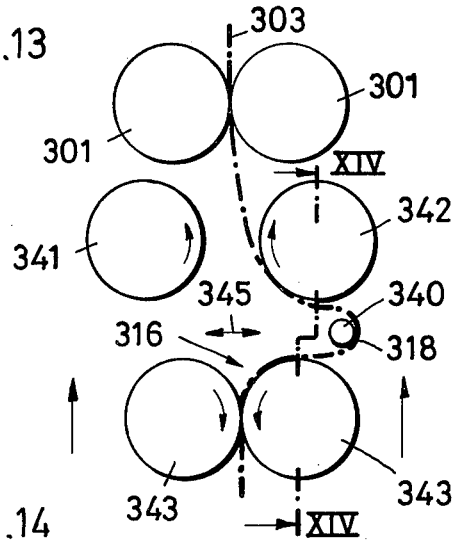
Figure 14:
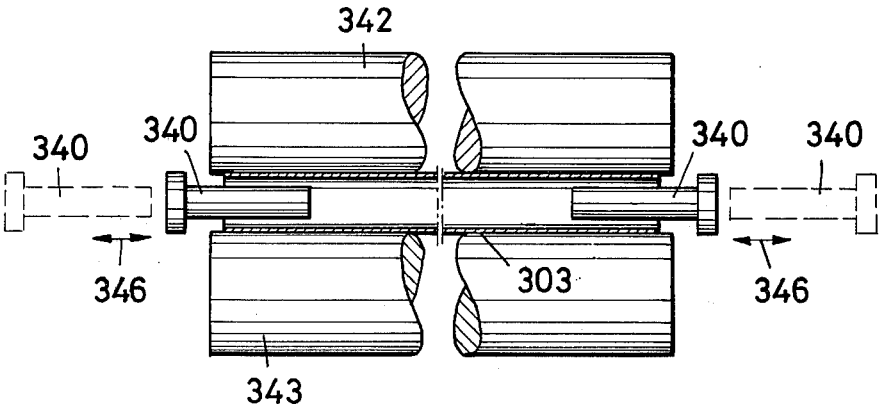

FIG. 8 corresponds to FIG. 7, during the pressing down of the folding loop;

FIG. 9 shows diagrammatically, corresponding to FIG. 7, a further embodiment of the folding apparatus before the formation of the loop;

FIG. 10 corresponds to FIG. 9, after the formation of the loop;

FIG. 11 corresponds to FIG. 9, during the pressing down of the folding loop;

FIG. 12 corresponds to FIG. 9 and shows a variant of the embodiment of the folding apparatus illustrated in FIGS. 9 to 11;

FIG. 13 corresponds to FIG. 10 and shows the embodiment illustrated in FIG. 12 after the formation of the folding loop; and FIG. 14 is a sectional view, taken along the line XIV—XIV in FIG. 13.

A sheet guide, formed by sheet metal plates 2, feeds sheet 3 in the direction indicated by the arrow 19 to a pair of conveying rollers 1 mounted in a support frame with their drive. The conveying rollers 1 feed the sheet 3 through a central gap 4 in a table 7 which is formed by two portions 5, 6 and has a flat table surface 8 extending perpendicularly to the direction of the sheet feed path.

Two folding rollers 9 are mounted in a support 10, spaced apart from one another to leave a gap 11 between them. The support 10 is guided by rollers 13 for longitudinal displacement (vertically as shown in FIGS. 1 to 5) in a retaining device 12, prestressed springs 14 urging the retaining device 12 and the support 10 against the table surface 8, so that the folding rollers 9 are applied with pressure against the table surface 8. A drive, for instance, a crank drive (not shown), controls the longitudinal movement of the support 10, in the direction shown by the double arrow 15, and therefore rolling movement of the folding rollers 9 on the table surface 8.

Figure 1:
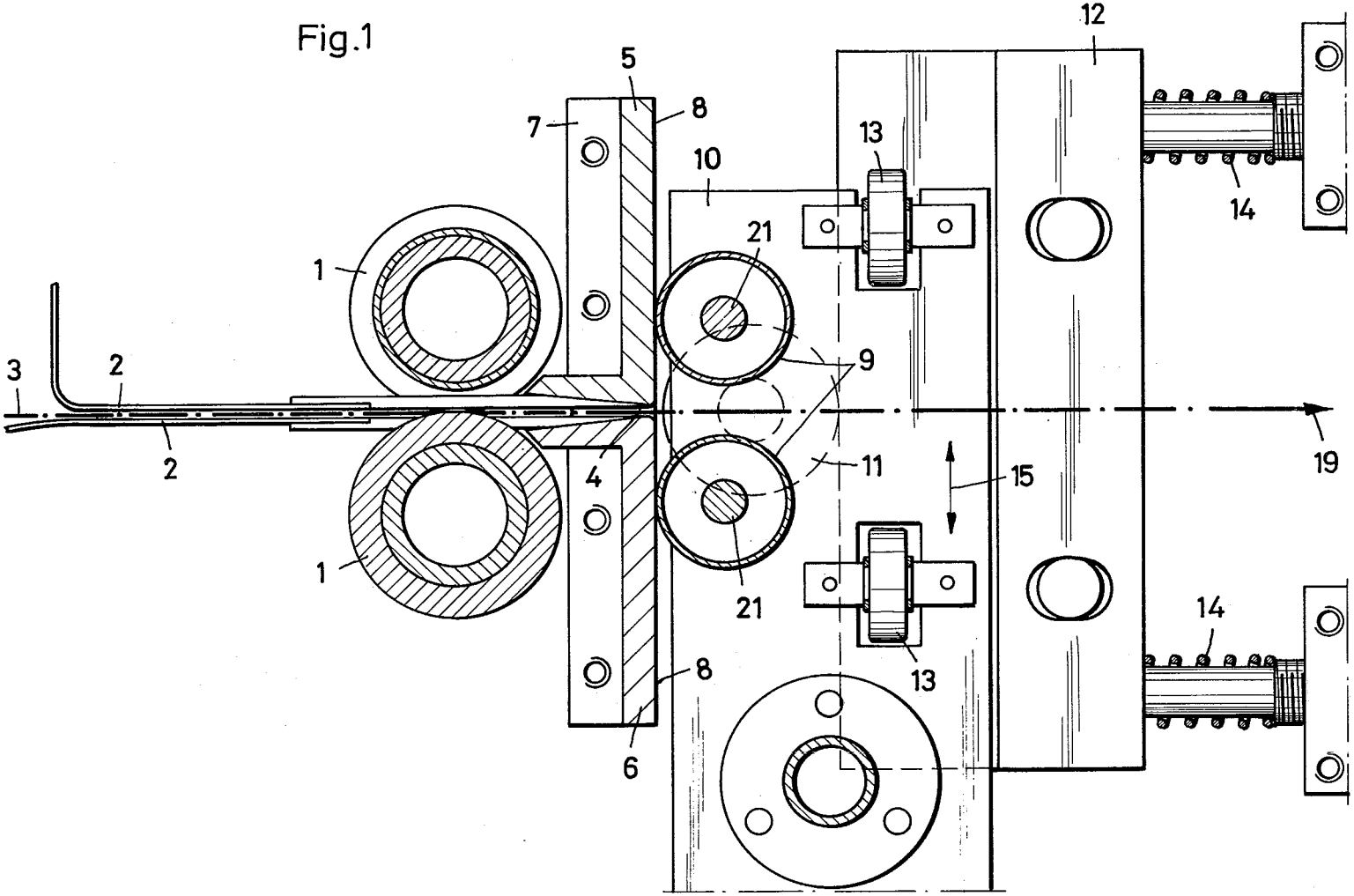
FIG. 1 is a cross-section through a detail of a folding apparatus, showing the conveying and advancing device and also the deflecting and folding device, in their starting positions.
Figure 2:
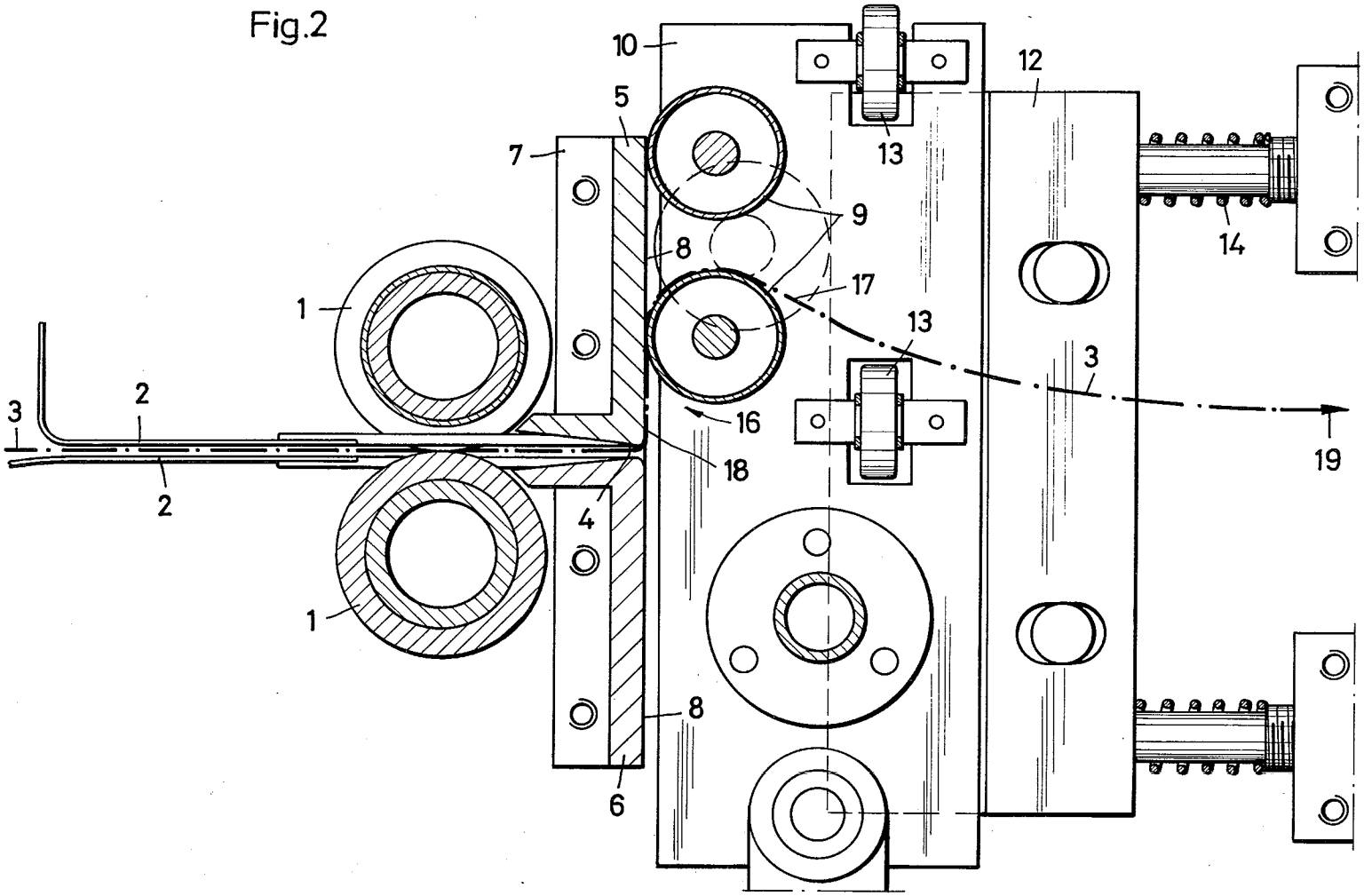
FIG. 2 is a cross-section, corresponding to FIG. 1 after the formation of the double loop.

FIGS. 2 to 5 illustrate the different steps during a folding operation. As shown in FIG. 2, the support 10 has moved into an uppermost position. The sheet 3 has been entrained by the bottom folding roller 9 so that a double loop 16 of generally S-shape has been formed in the sheet 3, the loop 16 consisting of a blind loop 17 extending around the folding roller 9 and a folding loop 18 formed around the edge of the top table portion 5. During the outward movement, the folding roller 9 forming the double loop 16 runs over a portion of the sheet between the gap 4 and the line of contact between the roller 9 and the table surface 8, and the sheet 3 is clamped against the table surface 8 by the roller.

Figure 3:
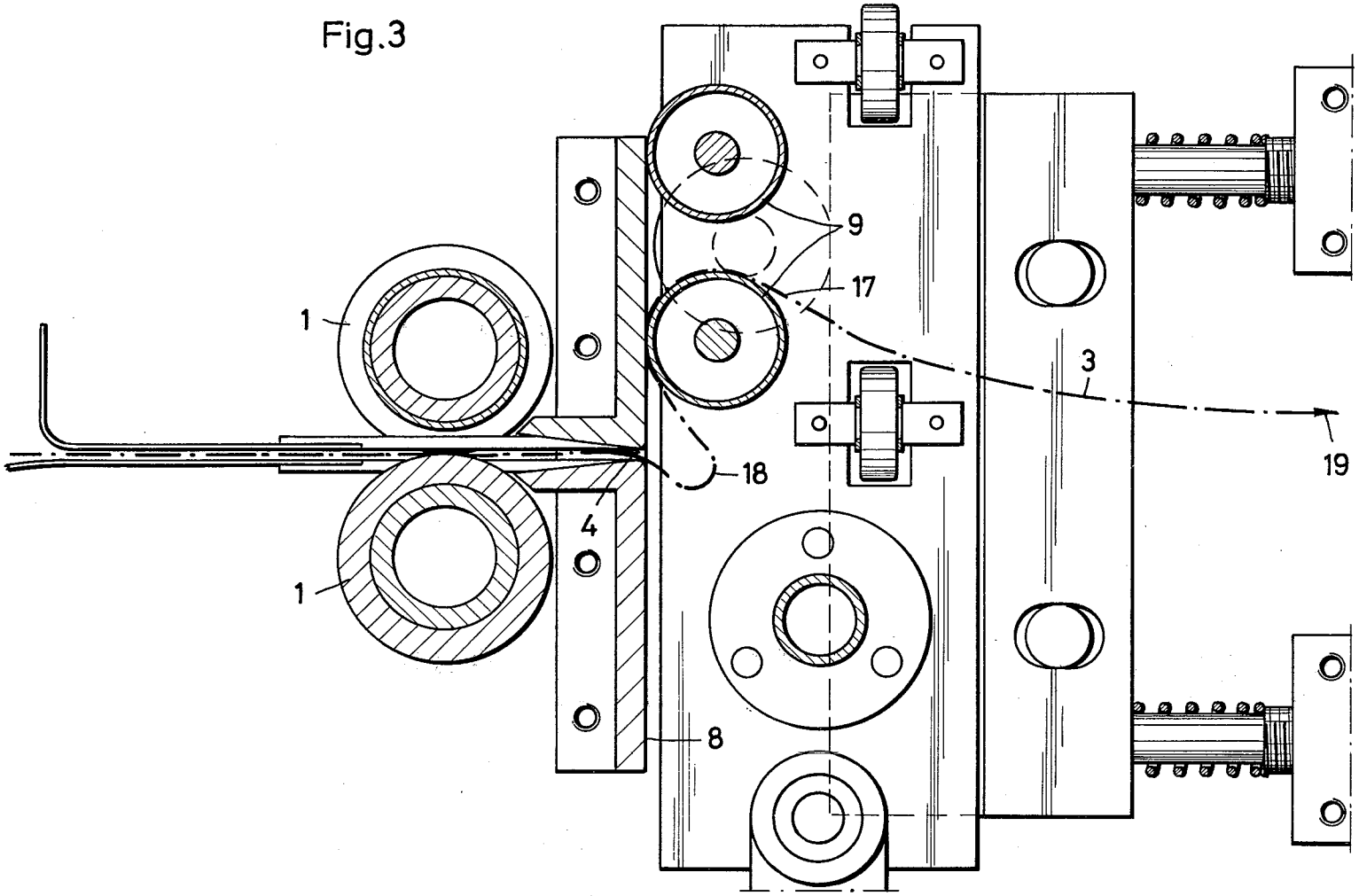
FIG. 3 is a cross-section, corresponding to FIG. 1 after increasing the size of the folding loop of the double loop.

During this rolling out, the conveying rollers 1 can be stationary and clamp the sheet 3, or alternatively they can continue to run, since the sheet is clamped by the roller 9. In the former case, when the operative folding roller 9 has reached the position shown in FIG. 2, the sheet feed by rollers 1 is restarted to give the folding loop a generally U-shaped form as shown in FIG. 3. If rollers 1 continue to run during displacement of the folding rollers, the U-shaped loop is formed during the upward movement of the folding roller 9.

Next the folding rollers undergo a return movement (downwards as shown in FIG. 3) with the conveying rollers 1 either stationary and clamping the sheet 3, or rotating to advance the sheet 3. As soon as the lower, operative folding roller 9 has passed the gap 4 on its reverse movement it presses the opposite sides of the folding loop 18 against the table surface 8. At this movement the size of the folding loop 18 and therefore the position of the fold is fixed. Any advancement of the sheet 3 by the conveying rollers 1 during this return movement of the folding rollers results in the formation of a fresh loop above the bottom folding roller 9 (FIG. 4), but the formation of such a loop does not affect the operation of the apparatus as will become clear from the following description.

Figure 4:
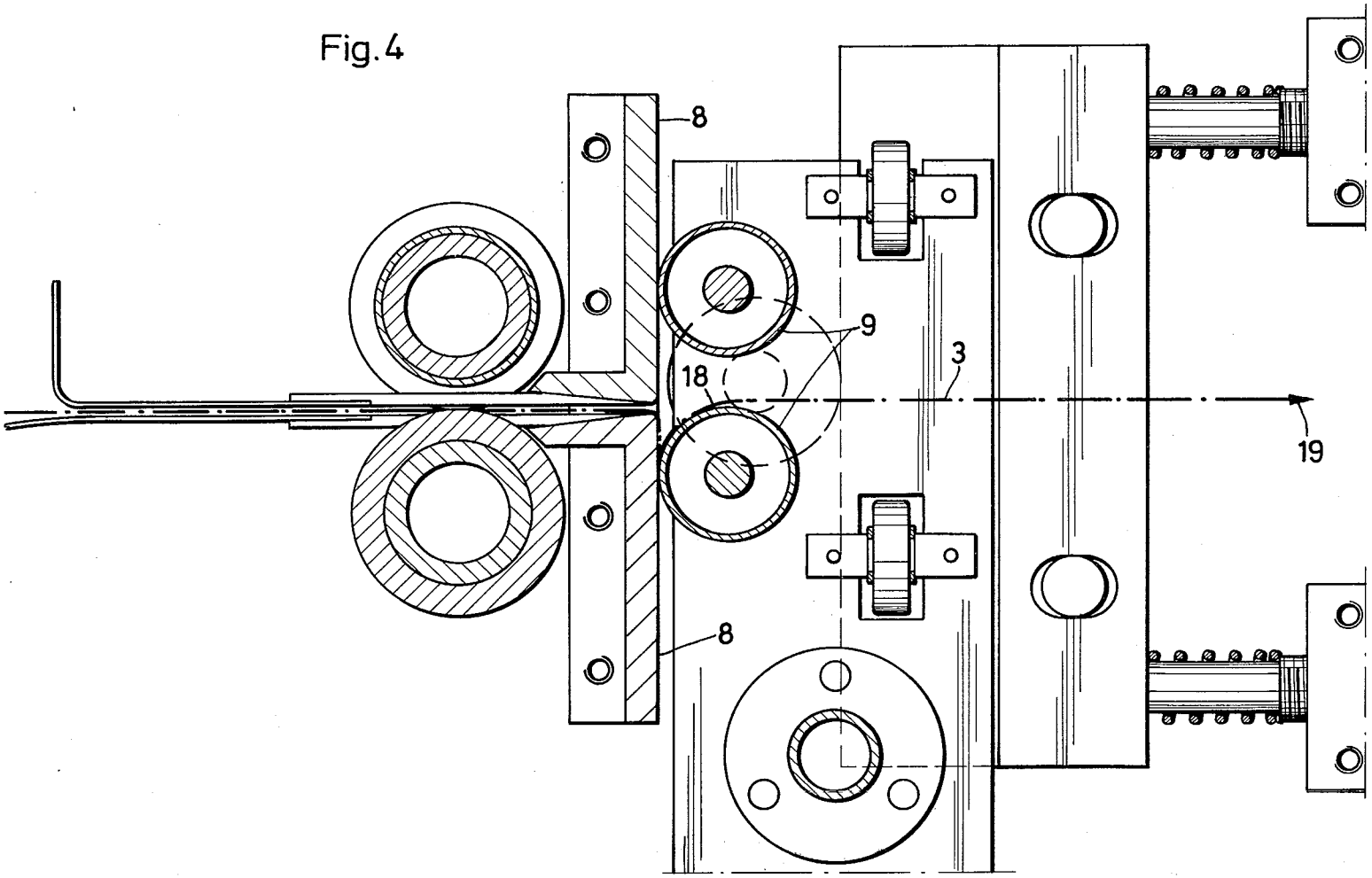
FIG. 4 is a cross-section, corresponding to FIG. 1, during the pressing down of the folding loop, i.e. during actual folding.

FIG. 4 shows the apparatus at the moment at which the folding loop 18 is pressed flat from the open end of the loop to its rounded closed end to produce the fold, the blind loop 17 being maintained during the pressing.

A continuous, but not constrained, pull is exerted on the portion of the sheet 3 downstream of the folding rollers 9. The pull can, for instance, be provided by the weight of the sheet itself, if the apparatus illustrated in FIGS. 1 to 5 is so turned through 90° that the table surface 8 lies horizontal and faces downwards.

Figure 5:
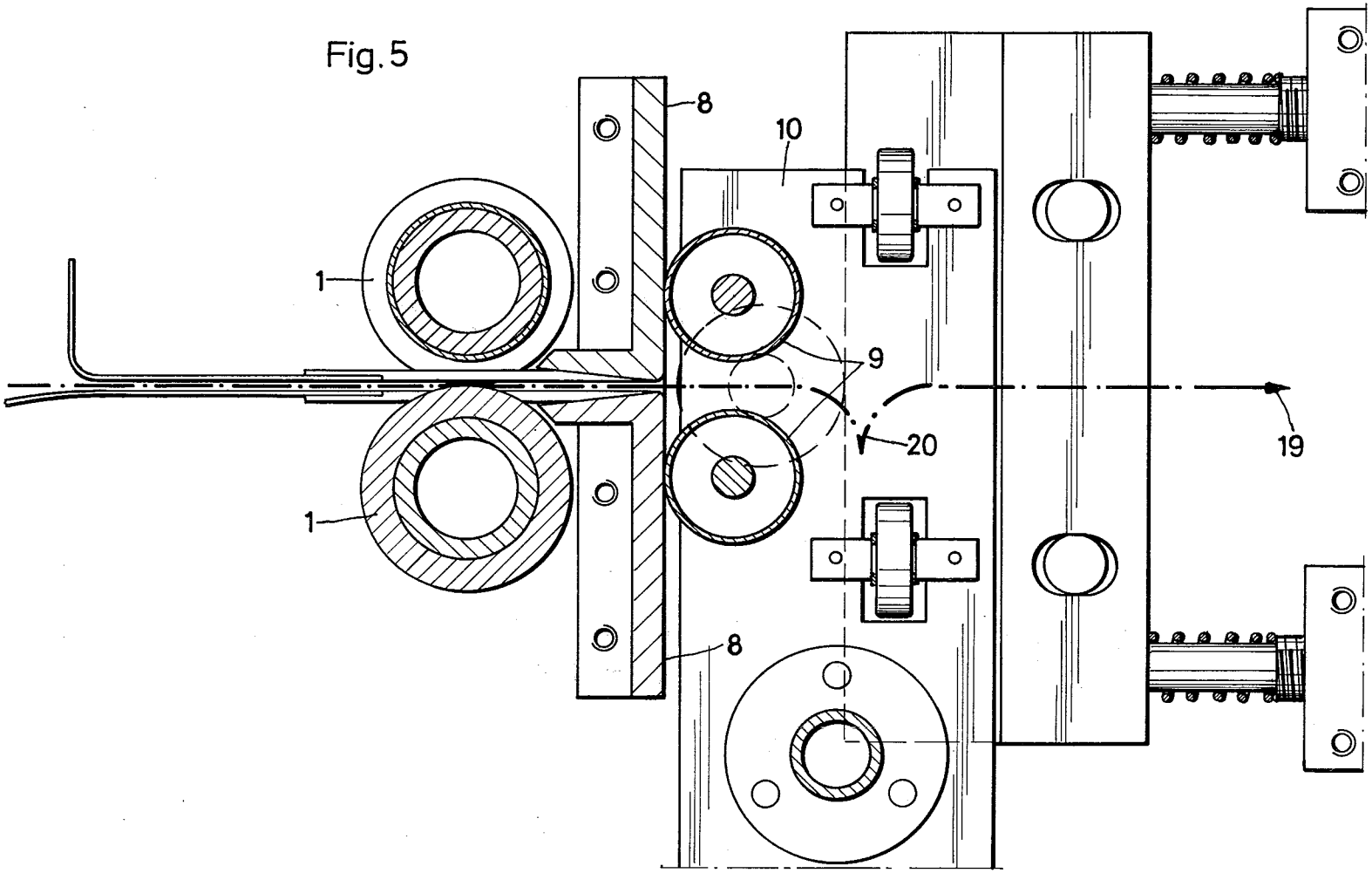
FIG. 5 is a cross-section, corresponding to FIG. 1, after the formation of the first folds and the return of the deflecting and folding device to the inoperative position.

As shown in FIG. 4, the folding rollers 9 have not yet reached their central starting position which is illustrated in FIG. 5. At some time before this initial position is reached, the fold 20 formed in the sheet 3 is released by the folding roller 9 and the sheet 3 continues to advance in the direction indicated by the arrow 19 under the influence of the pull exerted on the sheet.

During the following operational cycle, the upper folding roller 9 (as shown in FIGS. 1 to 5) will come into operation, moving downwards to a double S-shaped loop 16 in the sheet and then moving upwardly to press the folding loop 18 of the double loop down on the table surface 8 of the top table portion 5 to form a further fold, oppositely directed to the fold 20, in the sheet. The two folding rollers 9 do not have to be coupled to move together, as described, since the folding roller which is not operative during the production of a fold can remain stationary in an inoperative position. However, this requires the folding rollers 9 to be suitably controlled, substantially independently of one another.

Figure 6:
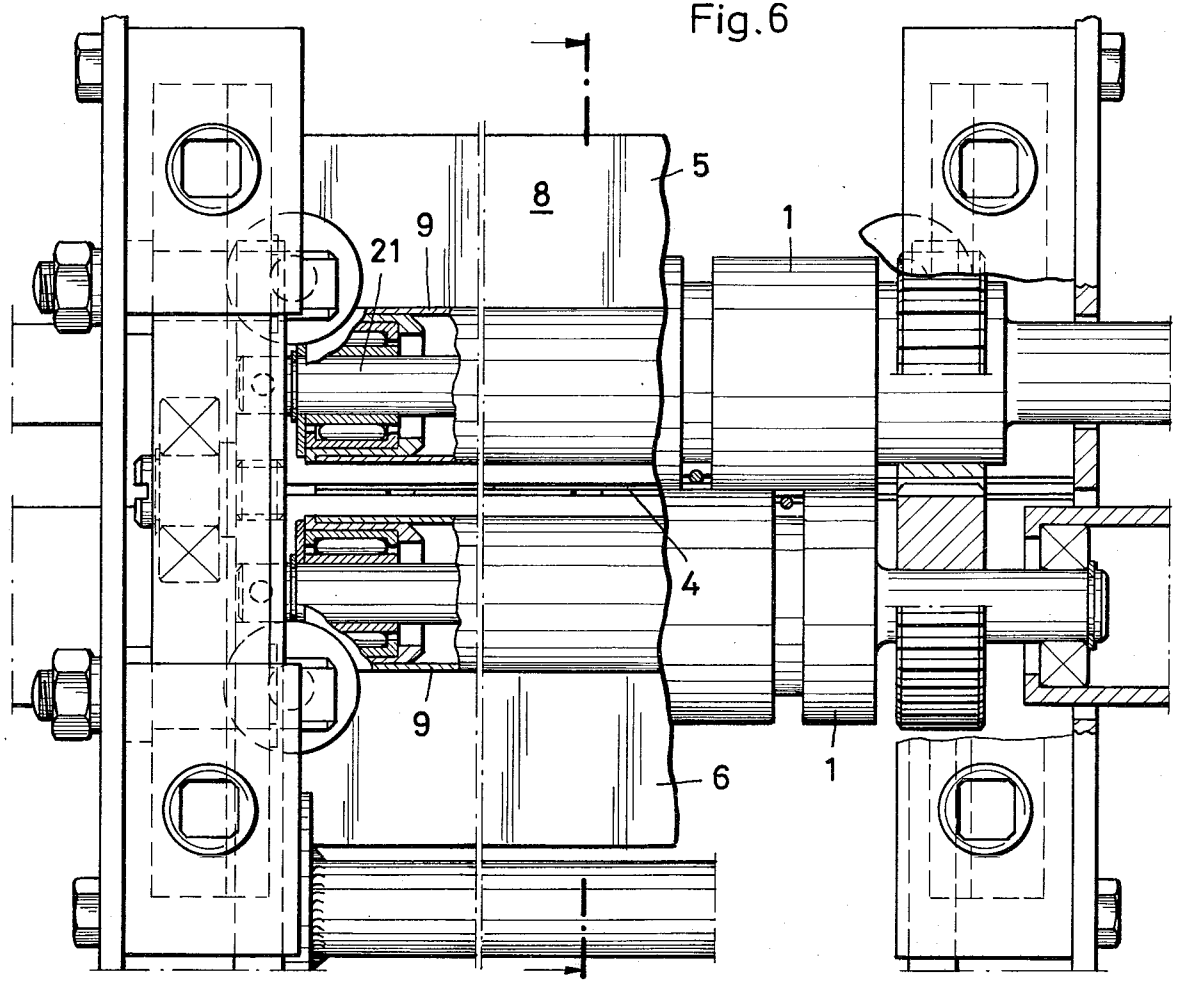
FIG. 6 is a partially opened-up and sectional view of the folding apparatus in the direction of advance of the sheet.

FIG. 6 illustrates the overall construction of the folding apparatus described with reference to FIGS. 1 to 5, and shows how the folding rollers 9 are mounted for free rotation on their axles 21.

The apparatus diagrammatically illustrated in FIGS. 7 and 8 has two folding rollers 109 which are coupled to one another in a similar manner to the folding rollers 9 in the previously described embodiment but they could alternatively be controlled independently of one another. For the reasons described hereinafter, however, a simple longitudinal displacement of folding rollers 109 is not enough and they must also move towards and away from the table surface 108.

The two portions of the table surface 108 which are formed by table portions 105, 106 are inclined to the perpendicular to the plane of advancement of the sheet 103, and oppositely and symmetrically located relative to that plane, as shown in the drawings. The table portions 105, 106 have rear extensions parallel with the direction of advance of the sheet, which form slideways for plates 131, 132 having the same width as that of the sheet and which define between them a guide channel 133 for the sheet 103. In the starting position (FIG. 7) the front portions 134, 135 of the plates 131, 132, project beyond the table surface 108 through the gap 104 between the two table portions 105, 106. The front edges 136 of the portions 134, 135 are rounded off as shown.

In operation the folding rollers 109 are moved out of their initial position (not shown) to the position shown in FIG. 7 to form a double, S-shaped loop 116, having a blind loop 117 and a folding loop 118, of U-shape. The blind loop is formed around the operative folding roller 109 and the folding loop is formed around the front portion 134 of the top plate 131. Then, by means of a control system (not shown), the top plate 131 is pulled back into the positions shown in FIG. 8 and the operative folding roller 109 moves back and presses the folding loop 118 against the exposed surface of the fully extended front portion 135 of the bottom plate 132 to form the fold. Then either the bottom plate 132 is retracted, or the operative folding roller 109 is guided around its front portion 135, back to its starting position to release the fold. The next folding operation is then commenced using the other folding roller. The conveying rollers for the sheet have been omitted in FIGS. 7 and 8.

FIGS. 9 to 11 and FIGS. 12 to 14 respectively illustrate schematically two further embodiments in which the folding rollers do not at the same time constitute deflecting devices for forming the loop. In the first of these embodiments, the sheet 203 is seized by a pair of clamping rollers 243 downstream of a deflecting device 240 and folding rollers 241, 242. The rollers 243 bear against and engage the sheet 203 to form the double, S-shaped loop 216 having a U-shaped folding loop 218 and blind loop 217 of opposite curvature. The clamping rollers 243 can be stationary, but it is sufficient for operation if their driving speed for the sheet in the direction of the arrows is retarded.

The deflecting device 240, which consists of a pivotable sheet guide disposed in the path of the sheet 203 between the folding rollers 241, 242, is pivoted laterally in the direction in which the folding loop 218 is to be formed (FIG. 10); this loop being produced by the slowing down or stopping of the clamping rollers 243 while the sheet advancing rollers 201 continue to run.

The clamping rollers 243, gripping the sheet 203, are then moved against the direction of advance of the sheet, as shown by the arrows 244 in FIG. 10, until that clamping roller 243 which is on the loop side, bears against the associated folding roller 242. As clearly shown by FIG. 11, the folding roller 242 rotates in the opposite direction to the clamping roller 243 associated therewith, and its speed of rotation is then increased so that the folding loop 218 is pressed between these cooperating rollers 243, 242 and is at the same time conveyed backwards towards the plane of the sheet feed path. This stage of the folding operation is not illustrated. In the next folding operation, a folding loop will be formed and pressed between rollers 241, 243.

In the embodiment illustrated in FIGS. 12 to 14 the pivotable sheet guide 240 is replaced by a pair of coaxial stub rollers or pins 340 which can be displaced transversely perpendicularly to the direction of advance of the sheet 303 between the facing clamping rollers 343 and folding rollers 341, 342, and can also be rotated around their longitudinal axes. The guides and bearings for the pins 340 have all been omitted to simplify the drawings. The arrows 345 in FIGS. 12 and 13 indicate the transverse displaceability of the pins 340, and as shown clearly in FIG. 14, the pins 340 can also be displaced, as indicated by the arrows 346, out of their operative positions, shown in solid lines, in the direction of their axes, into inoperative positions shown in chain lines.

When the clamping rollers 343 are brought into engagement with the sheet 303 ready to form the double, S-shaped loop 316 having a folding loop 318 (FIG. 13), the pins 340 are moved laterally as indicated by the arrow 345 in FIG. 12 and entrain the sheet 303, which may consist of a multi-layer bundle of sheets already folded in one direction. The clamping and folding rollers 343, 342 are moved together, as in the embodiment of FIGS. 9 to 11, and the pins 340 are withdrawn axially in the direction indicated by the arrows 346 in FIG. 14, so that they do not impede the pressing down of the folding loop 318 to complete the fold.

I claim:

1. A method of folding an elongated sheet of material such as paper or foil, comprising the steps of a. forming a double loop of substantially S-shaped configuration as viewed along an edge thereof in a portion of said sheet intermediate the ends thereof, said double loop including a folding loop with a rounded apex and a pair of legs extending therefrom, and a blind loop of opposite curvature to said folding loop displaced longitudinally of said sheet relative to said folding loop b. pressing together said pair of legs of said folding loop remotely from said apex of said loop progressively to said apex, to produce a fold in said sheet; and c. maintaining the shape of said blind loop substantially unaltered during said pressing step.

2. A method as claimed in claim 1, wherein said folding loop is formed from a first portion of sheet of predetermined length and a second portion of sheet of adjustable length, the method comprising the step of advancing a length of sheet towards said first portion to provide said second portion and thereby to adjust the size of said folding loop.

3. Apparatus for folding an elongated sheet of material, such as paper or foil, comprising means defining a sheet feed path; clamping means for gripping a sheet extending along said feed path to impede movement of said sheet; deflecting means for deflecting said sheet away from said path for forming a double loop of substantially S-shaped configuration as viewed along an edge thereof in a portion of said gripped sheet, said double loop including a folding loop with a rounded apex and a pair of legs extending therefrom, and a blind loop of opposite curvature to said folding loop displaced longitudinally of said sheet relative to said folding loop folding loop remotely from the apex progressively towards the apex, said folding and deflecting means being so arranged that the shape of said blind loop remains substantially unaltered during said pressing.

4. Apparatus as claimed in claim 3, wherein sheet advancing means is provided for advancing said sheet along said feed path.

5. An apparatus as claimed in claim 3, wherein said deflecting and folding means comprises a folding roller rotatable about an axis parallel with the plane of said sheet extending along said feed path and perpendicular to the feed direction, and a table is provided and has a surface extending transversely of said sheet feed path and on opposite sides thereof, said folding roller being cooperable with said table and movable relative thereto firstly in one direction to form said double loop and then in the opposite direction to press the folding loop against said table.

6. Apparatus as claimed in claim 5, wherein said table has edges adjacent said feed path and said edges are rounded off.

7. Apparatus as claimed in claim 5, wherein two spaced apart, parallel deflecting and folding rollers are provided for cooperation with said table, said rollers having an inoperative position relative to the table in which said rollers are located on opposite sides of said feed path.

8. Apparatus according to claim 7, wherein the table includes at least one plate which is movable relative to said table surface to project forwardly therefrom in forming the double loop in said sheet, and to be retracted behind the table surface during pressing the folding loop, said plate having a forward end edge which is rounded off.

9. Apparatus as claimed in claim 8, wherein the table has two said plates parallel with each other and independently movable relative to said table surface, said plates being disposed on opposite sides of said sheet feed path, and each said plate having a support surface against which the folding loop formed by the other said plate is pressed by one said folding roller.

10. Apparatus as claimed in claim 3, wherein said clamping means comprises a pair of clamping rollers cooperable to grip the sheet therebetween and positioned downstream of said deflecting means in said sheet feed path, and said folding means includes at least one folding roller movable into contact with one of said clamping rollers, said deflecting means being arranged to form said folding loop between said clamping and folding rollers which are movable into contact.

11. Apparatus as claimed in claim 10, wherein said deflecting means comprises a pivotably mounted sheet guide disposed along said sheet feed path adjacent said folding roller.

12. Apparatus as claimed in claim 10, wherein said deflecting means comprises a pair of rotatable stub rollers having axes which are aligned, said stub rollers being movable in a direction perpendicular to the sheet feed path between said clamping and folding rollers which are movable into contact, and said stub rollers being parallel with said clamping and folding rollers and movable axially out of engagement with a sheet extending along said feed path.

* * * * *

UNITED STATES PATENT AND TRADEMARK OFFICE

CERTIFICATE OF CORRECTION

PATENT NO. : 4,015,838

DATED : April 5, 1977

INVENTOR(S) : Wilhelm Thurmann

It is certified that error appears in the above-identified patent and that said Letters Patent are hereby corrected as shown below:

Col. 4, line 57, "movement" should be --moment--;

Col. 7, line 37, after "loop" (first occurrence) insert: --; and folding means for pressing together said legs of the--

Signed and Sealed this

*fifth* Day of *July 1977*

[SEAL]

*Attest:*

RUTH C. MASON
*Attesting Officer*

C. MARSHALL DANN
*Commissioner of Patents and Trademarks*